US008131195B2

(12) United States Patent
Ichizawa

(10) Patent No.: US 8,131,195 B2
(45) Date of Patent: Mar. 6, 2012

(54) ANNULAR BODY FOR SUPPRESSING ELECTRICAL DISCHARGE, ANNULAR BODY STRETCHING DEVICE AND IMAGE FORMING APPARATUS

(75) Inventor: Nobuyuki Ichizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 279 days.

(21) Appl. No.: 12/330,275

(22) Filed: Dec. 8, 2008

(65) Prior Publication Data

US 2009/0279924 A1 Nov. 12, 2009

(30) Foreign Application Priority Data

May 8, 2008 (JP) ..... 2008-122365

(51) Int. Cl.
*G03G 15/01* (2006.01)
*G03G 15/20* (2006.01)

(52) U.S. Cl. ..... 399/302; 399/308; 399/313

(58) Field of Classification Search ..... 399/308, 399/310, 313; 252/502; 428/339
See application file for complete search history.

(56) References Cited

U.S. PATENT DOCUMENTS

| | | | | |
|---|---|---|---|---|
| 5,655,199 | A * | 8/1997 | Yamashita et al. | 399/302 |
| 6,139,784 | A | 10/2000 | Oshima et al. | |
| 2002/0172819 | A1* | 11/2002 | Matsuo et al. | 428/323 |
| 2009/0041514 | A1* | 2/2009 | Maehara | 399/308 |

FOREIGN PATENT DOCUMENTS

| | | |
|---|---|---|
| JP | A-62-206567 | 9/1987 |
| JP | A-5-077252 | 3/1993 |
| JP | A-5-200904 | 8/1993 |
| JP | A-6-095521 | 4/1994 |
| JP | A-6-149079 | 5/1994 |
| JP | A-6-149081 | 5/1994 |
| JP | A-6-149083 | 5/1994 |
| JP | A-6-228335 | 8/1994 |
| JP | A-8-320622 | 12/1996 |
| JP | A-9-305038 | 11/1997 |
| JP | A-10-063115 | 3/1998 |
| JP | A-10-226028 | 8/1998 |
| JP | A-10-240020 | 9/1998 |
| JP | A-2001-265135 | 9/2001 |
| JP | A-2002-283368 | 10/2002 |
| JP | A-2003-12839 | 1/2003 |
| JP | A-2003-277522 | 10/2003 |
| JP | 2005266338 A * | 9/2005 |

OTHER PUBLICATIONS

Machine English translation of JP2005-266338.*

Office Action issued on May 11, 2010 in Japanese Patent Application No. 2008-122365 (with translation).

* cited by examiner

*Primary Examiner* — David Gray
*Assistant Examiner* — Billy J Lactaoen
(74) *Attorney, Agent, or Firm* — Oliff & Berridge, PLC

(57) ABSTRACT

The invention provides an annular body having an inner surface including a base material layer, the base material layer having a resin and a conductive agent, and the inner surface comprising a carbonized region. The invention further provides an annular body stretching device having: the annular body; and a stretching unit pushing outward the annular body with tension from an inner circumferential side of the annular body. The invention further provides an image forming apparatus having the annular body as an intermediate transfer body provided thereto. The invention further provides a method for forming the annular body, having forming a carbonized region by a process to give conductivity to the inner surface of the annular body.

14 Claims, 5 Drawing Sheets

ANNULAR BODY FOR SUPPRESSING ELECTRICAL DISCHARGE, ANNULAR BODY STRETCHING DEVICE AND IMAGE FORMING APPARATUS

CROSS-REFERENCE TO RELATED APPLICATION

This application claims priority under 35 USC 119 from Japanese Patent Application No. 2008-122365 filed May 8, 2008.

BACKGROUND

1. Technical Field

The present invention relates to an annular body, an annular body stretching device and an image forming apparatus.

2. Related Art

In an image forming device using an electrophotography format, a uniform charge is formed on an image bearing body which is a photoconductive photoreceptor comprising an inorganic or organic material, an electrostatic latent image is formed by laser light modulated by an image signal and the electrostatic latent image is developed with an electrified toner to obtain a visualized toner image. Then, by electrostatically transferring the toner image onto a transfer material such as a recording paper via an intermediate transfer body or directly, a required regenerated image is obtained.

SUMMARY

Usually, when electrical discharge occurs during transfer due to changes in kinds of paper, environments, use modes and the like, excessive voltage is momentarily applied to an intermediate transfer belt, and resistance of the intermediate transfer belt sharply decreases, which causes flow of high current. Thus, the electric charge of a toner is reversed, resulting in appearance of white spots in images formed from the toner. While the size of white spots can be small when the electrical discharge occurs in applications such as those in offices, the size of white spots may become larger when the electrical discharge occurs in applications such as those in the printing market or graphic arts, which require high image quality.

It is known that the solution to the phenomenon resides in increasing volume resistivity of an intermediate transfer belt. However, when volume resistivity is increased, electrical discharge occurs at the inner surface of an intermediate transfer belt from a back-up roll at a secondary transfer position, resulting in the formation of a flaky pattern.

In view of the above-described phenomenon, the present invention provides an annular body which suppresses electrical discharge from occurring at the inner surface of an intermediate transfer belt.

Namely, one aspect of an exemplary embodiment of the present invention is an annular body having an inner surface comprising a base material layer, the base material layer comprising a resin and a conductive agent, and the inner surface comprising a carbonized region.

One aspect of another exemplary embodiment of the present invention is an annular body stretching device comprising: the annular body; and a stretching unit pushing outward the annular body with tension from an inner circumferential side of the annular body.

One aspect of another exemplary embodiment of the present invention is an image forming apparatus comprising: an image holding unit; a charging unit that charges a surface of the image holding unit; a latent image forming unit that forms a latent image on a surface of the image holding unit; a developing unit that develops the latent image into a toner image; a primary transfer unit that transfers the toner image to an intermediate transfer body; a secondary transfer unit that transfers the toner image from the intermediate transfer body to a recording medium; and a fixing unit that fixes the toner image onto the recording medium, the intermediate transfer body being the annular body.

One aspect of still another exemplary embodiment of the present invention is a method for forming the annular body, comprising forming a carbonized region by a process to give conductivity to the inner surface of the annular body.

BRIEF DESCRIPTION OF THE DRAWINGS

Hereinafter, exemplary embodiments of the invention will be described in detail with reference to the drawings, wherein.

DETAILED DESCRIPTION

Hereinafter, exemplary embodiments of the invention will be described in detail with reference to the drawings.

Figure 1:
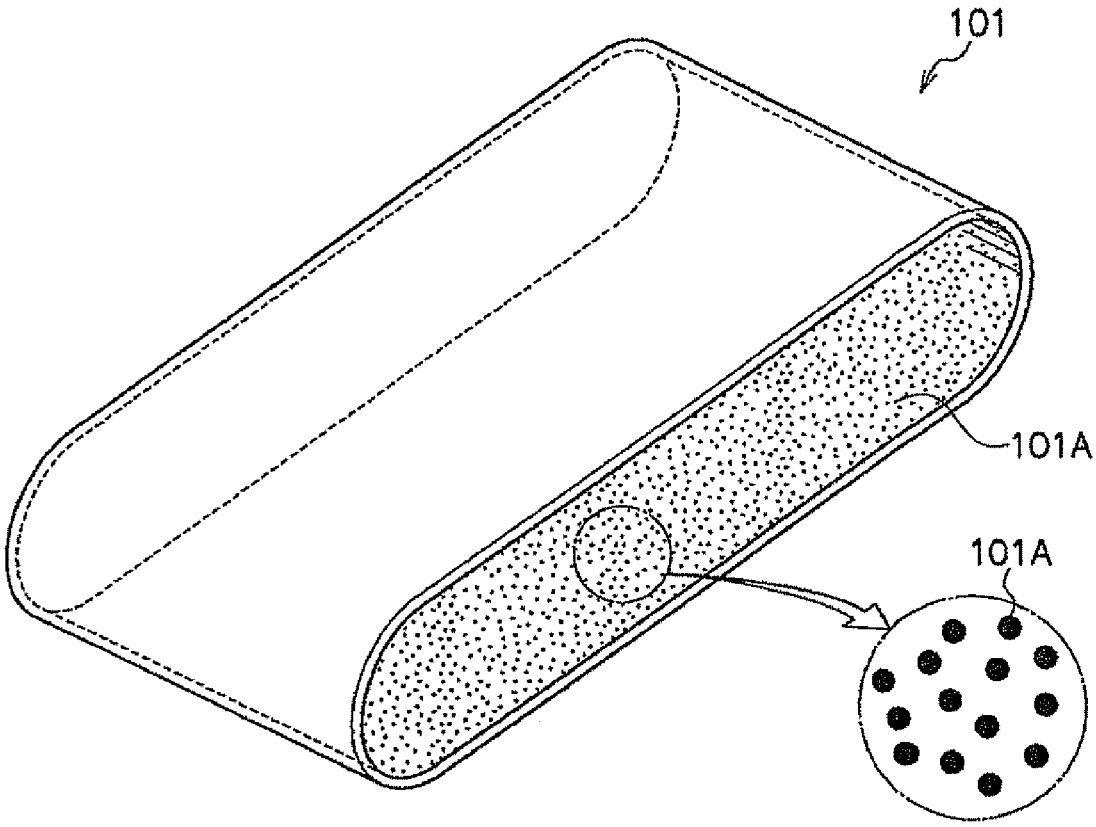
FIG. 1 is a schematic configuration diagram illustrating an intermediate transfer belt according to one exemplary embodiment of one aspect of the invention.
Figure 2:
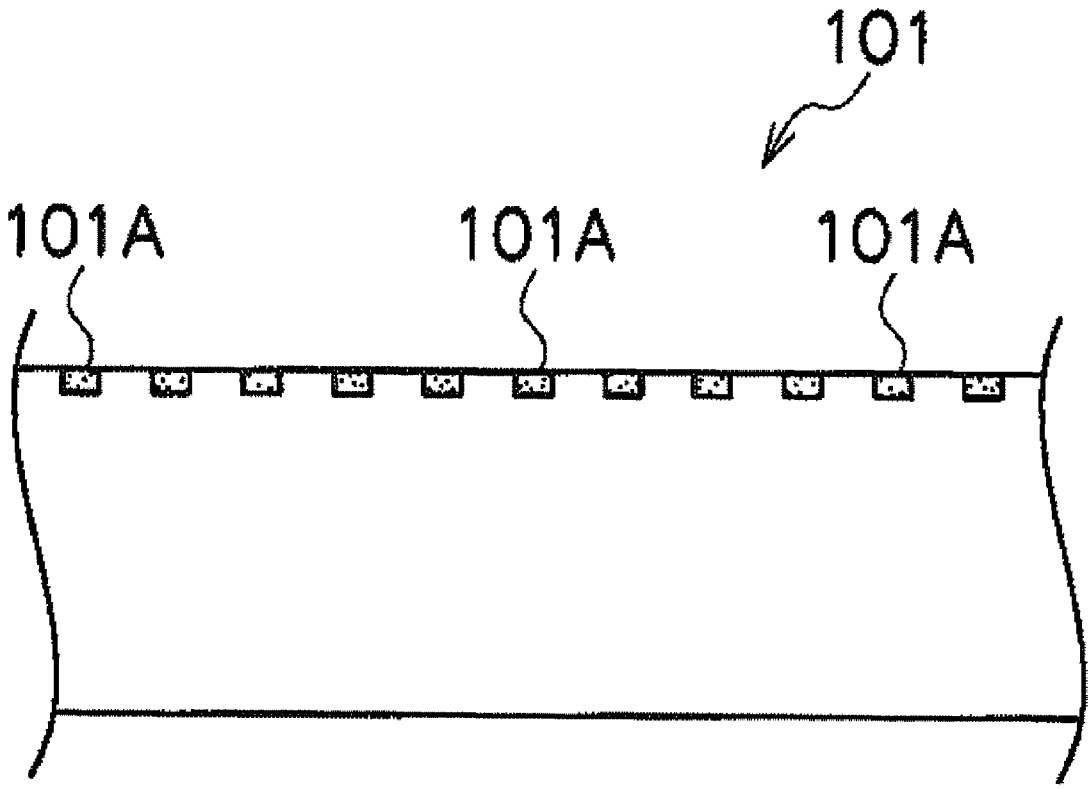
FIG. 2 is a schematic cross-sectional view illustrating the intermediate transfer belt of FIG. 1.

FIG. 1 is a schematic configuration diagram illustrating an intermediate transfer belt according to one exemplary embodiment of the invention. FIG. 2 is a schematic cross-sectional view illustrating the intermediate transfer belt shown in FIG. 1.

As shown in FIG. 1, an intermediate transfer belt 101 is formed to have an endless form, and contains an annular body containing a single-layered base material layer containing at least a resin and a conductive agent. While the intermediate transfer belt 101 exemplified herein contains a single-layered base material layer, the layer structure of the intermediate transfer belt according to the exemplary embodiment of the invention is not limited thereto. The layer structure may further contain a functional layer, such as a releasing layer, on the outer peripheral surface.

A carbonized region 101A, which corresponds to a region at which an inner surface (inner peripheral surface) of the intermediate transfer belt 101 is carbonized, is present on the inner surface of the intermediate transfer belt 101. The carbonized region 101A has a given surface form (e.g., spot forms such as a circular form or an oval form). A plurality of the carbonized region 101A resides on the inner surface in a sprinkled manner. The carbonized region 101A is formed of products obtained by carbonizing resins and impurities (e.g., ionic substances) which configure the base material layer. The "region at which the inner surface is carbonized" refers to the region at which a carbonized portion resides from the inner surface of the intermediate transfer belt to a given depth of the intermediate transfer belt in a belt thickness direction.

The carbonized region 101A functions as an electrically conductive path (electrically conductive site) of the inner surface of the belt, and thus the surface resistivity of the inner surface of the belt can be lower than that of the outer surface of the belt. The reduction in the surface resistivity of the inner surface of the belt can be achieved due to the presence of the carbonized region 101A, a thickness of which can be smaller than that of an electrically conductive layer which could be conventionally provided to the belt. Accordingly, when the intermediate transfer belt 101 according to the exemplary embodiment is used, an image in which the generation of a flaky pattern has been suppressed can be formed since electrical discharge does not occur at the inner surface.

The presence of the carbonized region 101A can be confirmed by XPS analysis (X-ray photo-electron spectral analysis). The XPS analysis method is generally used for elemental-analysis assay of the outermost surface of a material, and is excellent in sensitivity and reproducibility. The measurement can be carried out by a photoelectron spectrometer JPS-9010 (trade name, manufactured by JEOL Co, Ltd.). Specifically, the presence of the carbonized region 101A can be confirmed by detecting the difference (relative value) between a ratio of a peak area which is derived from carbon bonds in the outer surface of the belt relative to a peak area which is derived from all the chemical bonds in the outer surface of the belt and a ratio of a peak area which is derived from carbon bonds in the inner surface of the belt relative to a peak area which is derived from all the chemical bonds in the inner surface of the belt. More specifically, the presence of the carbonized region 101A can be confirmed by observing the difference between the content of —C—C— bonds (carbon bonds) with respect to chemical bonds of all elements in the outer surface of the belt and the content of —C—C— bonds with respect to chemical bonds of all elements in the inner surface of the belt.

In the exemplary embodiment, "the carbonized region 101A is present" means that the above-mentioned difference (relative value) is present. The difference may be a difference in the carbon peak area relative to the peak area of all the chemical bonds in the inner surface of the belt between before and after the process to give conductivity to the inner surface of the belt which will be mentioned later.

The XPS analysis for detecting the difference can be performed under an argon atmosphere, at an acceleration voltage of about 10 kV, and at an electric current of about 20 mA.

The limit of the thickness (i.e., the depth or the length in the belt thickness direction) of the carbonized region 101A may be up to about 10 μm from the inner surface according to a formation method explained in the following. From the viewpoint of effectively realizing effects, the thickness thereof is preferably from about 0.1 μm to about 7.0 μm from the inner surface. When the thickness exceeds the above range, accumulation of electric charge may occur at a boundary between the carbonized region and another area (interface of the carbonized region and another area), which may sometimes result in occurrence of non-uniformity in halftones or the like.

When the surface resistivity of the inner surface is measured while gradually polishing the inner surface of the intermediate transfer belt 101 with a wrapping paper, a point, which is revealed by removing a portion (film) with a polished thickness from the inner surface by the polishing and at which the measured surface resistivity is substantially the same as the surface resistivity of the outer surface of the intermediate transfer belt, is found. The thickness of the carbonized region 101A can be obtained from the polished thickness. More specifically, the polished thickness can be calculated from an initial thickness of the intermediate transfer belt and a thickness of the intermediate transfer belt resulting from polishing until the surface resistivity thereof becomes substantially the same as the surface resistivity of the outer surface of the intermediate transfer belt, and the thus-obtained polished thickness is regarded as the thickness of the carbonized region 101A.

Alternatively, at the inner surface of the belt, the surface resistivity before the process to give conductivity, which will be mentioned later, is measured, and the thickness of the intermediate transfer belt after polishing until the surface resistivities are in agreement is found to thereby calculate the polished thickness, which may be defined as the thickness of the carbonized region 101A. The thickness of the belt can be measured with a generally-used eddy-current coating thickness gauge. Specific examples of the eddy-current coating thickness gauge include a FISCHERSCOPE MMS (tradename, manufactured by FISCHER) and a CTR-1500E (tradename, manufactured by Sanko Electronics Co., Ltd.).

It is preferable that the carbonized region 101A is formed so that the surface resistivity of the inner surface of the intermediate transfer belt is lower than that of the outer surface of the intermediate transfer belt and the difference between the surface resistivities is in the range of about 0.5 log Ω/□ to about 2.0 log Ω/□, preferably in the range of about 0.7 log Ω/□ to about 1.5 log Ω/□, and more preferably in the range of about 0.8 log Ω/□ to about 1.0 log Ω/□. It is preferable that the surface resistivity of the inner surface of the intermediate transfer belt itself is about $1\times10^{11}$Ω/□ to about $1\times10^{13}$Ω/□, preferably about $5\times10^{11}$Ω/□ to about $1\times10^{13}$Ω/□, and more preferably about $1\times10^{12}$Ω/□ to about $1\times10^{13}$Ω/□. The "surface resistivity" is a value obtained when measurement thereof is performed under application of about 500 V for about 10 seconds.

Fine line reproducibility; toner dust-suppression property and the like may be deteriorated when the surface resistivity of the inner surface and the surface resistivity of the outer surface of the intermediate transfer belt are similar. On the other hand, non-uniformity in halftones may be deteriorated when the difference between the surface resistivity of the inner surface and the surface resistivity of the outer surface of the intermediate transfer belt is excessively large. Further, a flaky pattern may be likely to develop when the surface resistivity of the inner surface of the intermediate transfer belt exceeds the above-mentioned range, and a white patch may appear when the surface resistivity of the inner surface of the intermediate transfer belt is lower than the above-mentioned range.

The formation of a flaky pattern may be prevented by lowering the resistivity of the inner surface of the intermediate transfer belt.

However, it can be difficult to differentiate resistivities of a front surface and a rear surface of an intermediate transfer belt when it is a single-layered belt. Although a method including differentiating the resistivity of the inner surface from the resistivity of the outer surface of a single-layered belt by, for example, gradually changing resistivity of a material of the belt along the direction of the thickness of the belt may be considered, since the method is effected by adjustment of a production method, the degree of freedom of controlling the resistivity thereby may be small, so as to make the control of the resistivity to a desired value difficult, and thus, use thereof can be impractical.

On the other hand, when only the resistivity of the inner surface of a multilayer-structured intermediate transfer belt is reduced, electric charge can be accumulated at boundaries where the resistivities are different, resulting in occurrence of non-uniformity in medium-contrast images such as halftone images. Such non-uniformity may be remarkably generated when the difference between the resistivity of the inner surface and the resistivity of the outer surface is large and the film thickness of an inner surface layer is large. In particular, in the case that the intermediate transfer belt has a multilayer-structure, non-uniformity may occur even when the film thickness of the inner surface layer is 10 μm. While a layer with a thickness of several micrometers can be formed by coating, the film formation by coating may cause variances in film thickness, resulting in the above-mentioned non-uniformity.

Figure 3A:
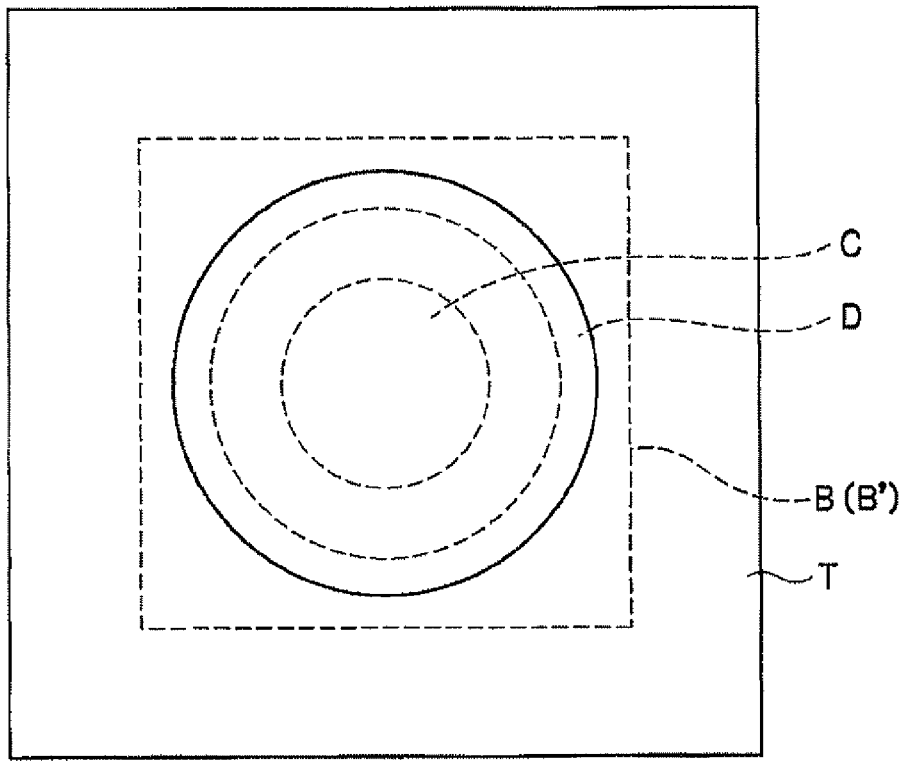
FIG. 3A is a schematic plan view illustrating an example of a circular electrode.
Figure 3B:
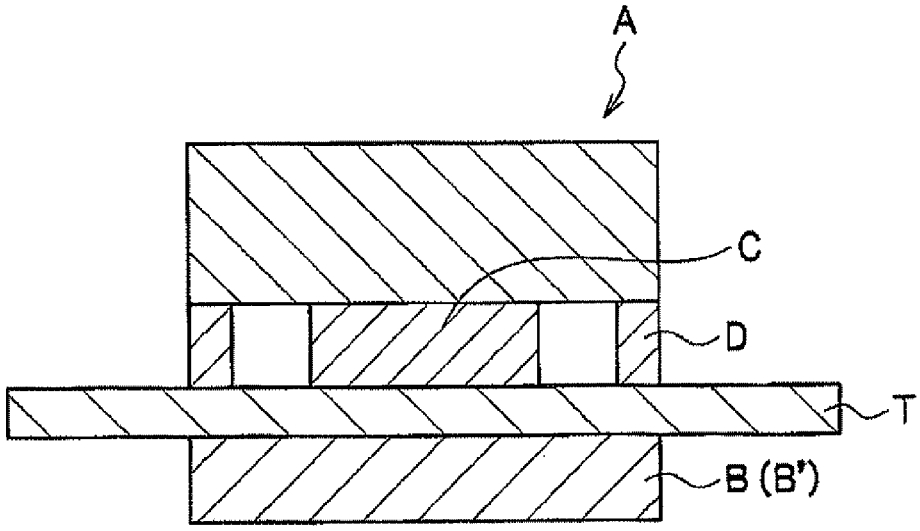
FIG. 3B is a schematic cross-sectional view thereof.

The surface resistivity can be measured using a circular electrode (e.g. trade name: UR PROBE of HIRESTA-UP, manufactured by Mitsubishi Chemical CO., Ltd & DAIAINSTRUMENTS CO., Ltd.) according to a known surface resistivity measuring method JIS K6911. The method of measuring surface resistivity is specifically explained with reference to the drawings. FIG. 3A is a schematic plane view showing one example of a circular electrode, and FIG. 3B is a schematic cross-sectional view thereof. A circular electrode shown in FIGS. 3A and 3B is provided with a first voltage application electrode A and a plate-like insulating body B. The first voltage application electrode A is provided with a cylindrical electrode part C, and a cylindrical ring-like electrode part D having an internal diameter larger than an external diameter of the cylindrical electrode part C, and which surrounds the cylindrical electrode part C at a constant interval. An intermediate transfer body T is held between the cylindrical electrode part C and the ring-like electrode part D at the first voltage application electrode A, and the plate-like insulating body B, and a voltage V (V) is applied between the cylindrical electrode part C and the ring-like electrode part D at the first voltage application electrode A, and a current I (A) which flows thereupon is measured, and the surface resistivity ρs (Ω/□) of the transfer surface of the intermediate transfer body T can be calculated by the following equation. In the following equation, d represents an external diameter of a cylindrical electrode part C (mm), and D represents an internal diameter of a ring-like electrode part D (mm).

$$\rho s=\pi\times(D+d)/(D-d)\times(V/I) \quad \text{Equation}$$

Examples of a method of forming the carbonized region 101A include subjecting the intermediate transfer belt (base material layer) to a process to give conductivity. The process to give conductivity to the intermediate transfer belt includes bringing paper into contact with the inner surface of the intermediate transfer belt to provide an electric field to the belt. The process to give conductivity to the inner surface of the intermediate transfer belt enables to easily form the carbonized region while adjusting the surface resistivity of the belt. In the process to give conductivity, electrical discharge between the intermediate transfer belt and the paper works as high stress. Therefore, it is preferable to repeat contact-and-separation between the intermediate transfer belt and the paper so as to cause electrical discharge.

Figure 4:
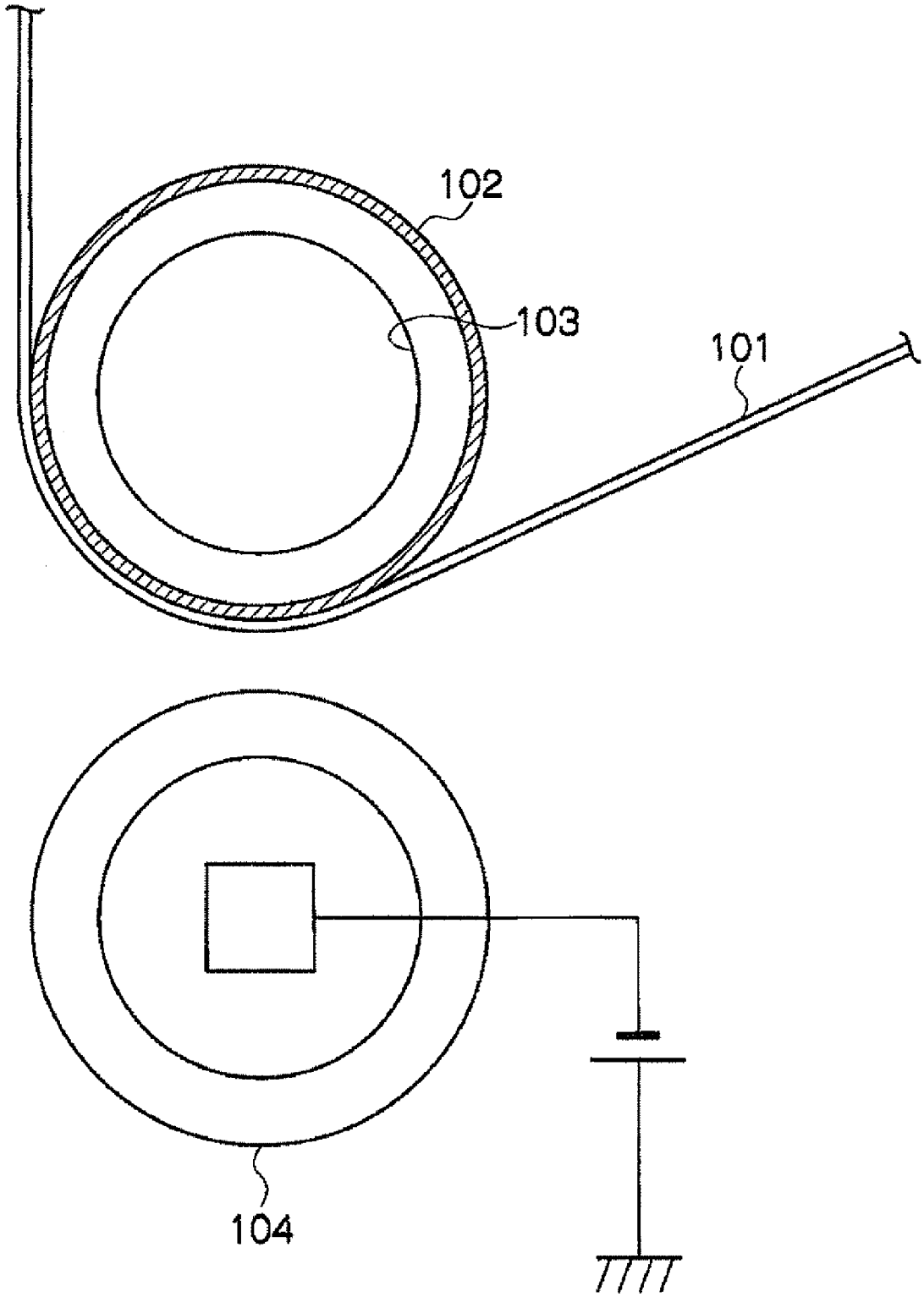
FIG. 4 is a schematic diagram for explanation of a process to give conductivity to inner surface of the intermediate transfer belt.

The process to give conductivity to the intermediate transfer belt will be described in detail with reference to the drawings. FIG. 4 is a schematic diagram describing the process to give conductivity to the intermediate transfer belt. As shown in FIG. 4, a support roll 103, on the outer peripheral surface of which paper 102 is wound around, is brought into contact with the inner peripheral surface of the intermediate transfer belt 101, and a voltage application roll 104 is contacted to the intermediate transfer belt 101, so that the intermediate transfer belt is positioned between the support roll 103 and the voltage application roll 104, which work as a roller pair. Thus, the paper 102 is in contact with the inner surface of the intermediate transfer belt 101. When a voltage is applied by the voltage application roll 104 in this state while rotating the roller pair, the intermediate transfer belt 101 and the paper 102 repeat contacting to and separation from each other, causing separation discharge therebetween. Due to the electrical discharge phenomenon, the inner surface of the intermediate transfer belt 101 is carbonized to form the carbonized region 101A. The process to give conductivity over the entire circumference of the inner surface of the belt can be performed by performing the voltage application while rotating the roller pair.

This system can be employed in one exemplary embodiment of the process to give conductivity to the intermediate transfer belt. Alternatively, a method including performing corona discharge or arc discharge in the surface direction while forming an electrical potential difference in the intermediate transfer belt 101 may also be employed.

The voltage applied when the process to give conductivity to the intermediate transfer belt is performed cannot generally be defined because it varies depending on a feeding method or resistance of a feeding material. The applied voltage can be preferably controlled by a current value. It is preferable that a value of current passing through the intermediate transfer belt is in the range of about 10 μA to about 100 μA (preferably about 30 μA to about 100 μA). The process to give conductivity to the intermediate transfer belt can be performed in a short time by high value of current. However, when the total thickness of the intermediate transfer belt 101 and the paper 102 is in the range of about 150 μm to about 600 μm, an electrical potential difference of about 10 kV or more may be formed to cause film breakage. When a current value is lower than the above range, electrical discharge may be weak and the process to give conductivity to the inner surface of the intermediate transfer belt may take a long time. When a current value exceeds the above range, a possibility of causing a dielectric breakdown may become high, although it depends on the film thickness and the resistance value of the intermediate transfer belt 101.

A lower-humidity environment is effective when the process to give conductivity to the inner surface of the intermediate transfer belt is performed. As a reference herein, in terms of absolute humidity, 2.7 g/m$^3$ or lower is preferable, and 1.3 g/m$^3$ or lower is more preferable.

The number of times of the contact-and-separation when the process to give conductivity to the inner surface of the intermediate transfer belt is performed is approximately 5,000 times under the conditions of about 20 μA and about 2 g/m$^3$, and is approximately 200 times under the conditions of about 40 μA and about 2 g/m$^3$, while these numbers are no more than references employed herein. The number of times thereof is not specified since it may vary depending on absolute humidity, a feeding system, or a source capacity. The number of times of contact-and-separation employed in the above system refers to the number of times in which one rotation in the belt circumferential direction is defined as one time.

Next, the paper 102 used for the process to give conductivity to the intermediate transfer belt will be described. (Hereinafter, reference numerals are omitted for the description.) So-called regular paper is preferable as the paper because a regular paper is a high resistor under a damp environment, has flexibility and excellent adhesiveness with the intermediate transfer belt, and is available at low cost.

Specific examples of the paper include those formed of: a chemical pulp, which is produced by chemically treating a fiber raw material, such as a wood material, cotton, hemp, or bast, and examples thereof include bleached kraft pulp of broad-leaved tree, unbleached kraft pulp of broad-leaved tree, bleached kraft pulp of needle-leaved tree, unbleached kraft pulp of needle-leaved tree, bleached sulfite kraft pulp of broad-leaved tree, unbleached sulfite kraft pulp of broad-leaved tree, bleached sulfite pulp of needle-leaved tree, and unbleached sulfite pulp of needle-leaved tree; a ground wood pulp, which is produced by mechanically treating a wood material or a chip; a chemi-mechanical pulp, which is produced by impregnating a wood material or a chip with a chemical solution and then performing mechanical treatment; or a thermo-mechanical pulp, which is produced by steam-digesting a chip until the chip becomes soft, and further subjecting the steam-digested chip with a refiner. These may be formed of either only virgin pulp or substances to which a recycled pulp has been added.

The paper may further contain a filler which is added so as to adjust opaqueness, whiteness, and surface properties thereof. Examples of the filler include: inorganic fillers and organic fillers. Examples of the inorganic fillers include: calcium carbonate such as heavy calcium carbonate heavy calcium carbonate, precipitated calcium carbonate, or chalk; silicic acids such as kaolin, calcined clay, pyrophyllite, sericite, or talc; saponite; calcium montmorillonite; sodium montmorillonite; or bentonite, and Examples of the organic fillers include urea resin and starch fiber. The paper may further contain a surface sizing agent. Examples of the surface sizing agent include a rosin sizing agent, a synthetic sizing agent, a petroleum resin sizing agent, a neutral sizing agent, starch, and polyvinyl alcohol.

The paper may further contain a conductive agent to adjust the surface electric resistance value thereof. Examples of the conductive agent include: inorganic electrolytes such as sodium sulfate, sodium carbonate, lithium carbonate, metasodium silicate, sodium tripolyphosphate, or sodium metaphosphate; anionic surfactants such as sulfonate, sulfuric ester salt, carboxylate, or phosphate; cationic surfactants; nonionic surfactants such as polyethylene glycol, glycerol, or sorbitol; amphoteric surfactants; and polyelectrolyte.

While there are preferable values for properties of a common paper, the preferable values are no more than references used for stabilization of paper and cannot be regarded as restrictive conditions. For example, the paper may have a surface electrical resistance value of about $5\times10^{9}\Omega$ to about $1\times10^{12}\Omega$ under 23° C. of atmospheric temperature and 50% of relative humidity, which correspond to the standard atmosphere as specified in JIS P8111-1998. The surface electrical resistance value can be measured by a method according to JISK6911. The weight of the paper weighed according to JIS P8124 (modification of ISO 536 1995) is preferably in the range of about 75 g/m$^2$ to about 95 g/m$^2$. The Bekk smoothness of each of the front and rear surfaces of the paper measured according to JIS P8119 (modification of ISO 5627 1995) is preferably in the range of about 65 seconds to about 120 seconds. The density of the paper measured according to JIS P8118 (modification of ISO 534 1988) is preferably about 0.80 g/cm$^3$ or more. The degree of shrinkage of the paper in the cross direction (CD: right-angle direction relative to the direction of movement of a paper machine) when the condition is changed from that with a temperature of 20° C. and a humidity of 65% RH to that with a temperature of 20° C. and a humidity of 25% RH is preferably about 0.45%. The modulus of elasticity in tension (E (kgf/mm$^2$) in the cross direction of paper and the thickness (t (mm)) of the paper preferably satisfy the relationship of $E\cdot t^3\geqq0.26$ when the paper is pretreated according to JIS-P-8118. Further, the fiber orientation ratio measured by an ultrasonic transmitting method with respect to the machine direction (MD: direction of movement of a paper machine) relative to the cross direction is preferably about 1.10 to about 1.30.

Hereinafter, each component configuring the intermediate transfer belt will be described in detail.

The intermediate transfer belt according to the exemplary embodiment is configured by a base material layer containing at least a resin and a conductive agent. While the Young's modulus of the resin may vary according to the thickness of the belt, it is preferably 3,500 MPa or more, and more preferably 4,000 MPa or more, in view of satisfying machine properties as a belt. There is no particular limitation to the resin insofar as the resin satisfies the condition of the Young's modulus. Examples of the resin include a polyimide resin, a polyamide resin, a polyamide imide resin, a polyether ether ester resin, a polyarylate resin, a polyester resin, and a polyester resin to which a reinforcer is added.

The Young's modulus can be determined based on inclination of a tangent line drawn to the curve of the initial strain area of the stress-strain curve obtained by performing a tensile test according to JIS K7127 (1999), that substantially accords to ISO 527-3 1995. The measurement can be performed using a rectangular test piece (about 6 mm in width and about 130 mm in length) and a dumbbell No. 1 at a test rate of about 500 mm/m while adjusting the thickness to the thickness of a belt body.

Among the resins described above, a resin having a high Young's modulus is preferable from the viewpoint that image defects such as misregistration of color images formed of toner hardly occur due to little deformation property thereof at the time of driving (stress of a support role a cleaning blade, or the like) of a belt formed of such resin. A polyimide resin, which can provide an intermediate transfer belt having a high Young's modulus, is particularly preferable.

Since a polyimide resin is a high Young's modulus material, deformation due to at driving (, namely, deformation due to a stress from a supporting roll or a cleaning blade) is small. Therefore, an intermediate transfer belt which hardly causes image defects such as color misregistration can be obtained by using a polyimide resin as a main component. A polyimide resin can be usually obtained as a polyamide acid solution by polymerization-reacting an equivalent mole of tetracarboxylic acid dianhydride or a derivative thereof and a diamine in a solvent. Examples of tetracarboxylic acid dianhydride include a dianhydride represented by the following Formula (I).

Formula (I)

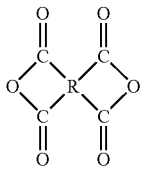

In Formula (I), R is a tetravalent organic group, and is an aromatic group, an aliphatic group, an alicyclic group, a combination of an aromatic group and an aliphatic group, or a substituted group of any one of these.

Specific examples of tetracarboxylic acid dianhydride include pyromellitic acid dianhydride, 3,3',4,4'-benzophenonetetracarboxylic acid dianhydride, 3,3',4,4'-biphenyltetracarboxylic acid dianhydride, 2,3,3',4-biphenyltetracarboxylic acid dianhydride, 2,3,6,7-naphthalenetetracarboxylc acid dianhydride, 1,2,5,6-naphthalenetetracarboxylic acid dianhydride, 1,4,5,8-naphthalenetetracarboxylic acid dianhydride, 2,2'-bis(3,4-dicarboxyphenyl)sulfonic acid dianhydride, perylene-3,4,9,10-tetracarboxylic acid dianhydride, bis(3,4-dicarboxyphenyl)ether dianhydride, and ethylenetetracarboxylic acid dianhydride.

On the other hand, specific examples of diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl-4,4'-biphenyldiamino, benzidine, 3,3'-dimethylbenzidine, 3,3'-dimethoxybenzidine, 4,4'-diaminodiphenylsulfone, 4,4'-diaminodiphenylpropane, 2,4-bis(β-aminotertiarybutyl) toluene, bis (p-β-aminotertiarybutyl phenyl)ether, bis (p-βp-methyl-δ-aminophenyl) benzene, bis-p-(1,1-dimethyl-5-amino-bentyl)benzene, 1-isopropyl-2,4-m-phenylenediamine, m-xylylenediamine, p-xylylenediamine, di (p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_{12})NH_2$, $H_2N(CH_2)_3S(CH_2)_3NH_2$, and $H_2N(CH_2)_3N(CH_3)_2(CH_2)_3NH_2$.

Preferable examples of a solvent when tetracarboxylic acid dianhydride and diamine are polymerization-reacted include a polar solvent (organic polar solvent) from a viewpoint of solubility. As a polar solvent, N,N-dialkylamides are preferable, and examples thereof include N,N-dimethylformamide, N,N-dimethylacetamide, N,N-diethylformamide, N,N-diethylacetamide, N,N-dimethylmethoxyacetamide, dimethyl sulfoxide, hexamethylphosphortriamide, N-methyl-2-pyrrolidone, pyridine, tetramethylenesulfone, and dimethyltetramethylenesulfone which have a low molecular weight. These can be used alone or in combination of plurality of them.

Next, a conductive agent will be described. Conductive or semiconductive fine powers can be used as the conductive agent. There is no particular limitation on electrical conductivity of the conductive agent as long as it facilitates stably providing a desired electrical resistance to the belt. Examples of the conductive agent include: carbon black such as Ketjenblack, acetylene black, or oxidation-treated carbon black having a pH of 5 or lower; metals such as aluminum or nickel; metal oxide compounds such as a tin oxide; and potassium titanate. These substances may be used singly or in combination, and carbon black is preferable in view of its advantage in price. The "conductive" used herein means that the volume resistivity is lower than about $10^7$ Ωcm. Further, the "semiconductive" means that the volume resistivity is from about $10^7$ to about $10^3$ Ωcm. The same meanings are applied thereto in the following description.

Two or more kinds of carbon blacks may be used in combination. Carbon blacks which are used in combination are preferably different from each other in conductivity. For example, a combination of carbon blacks which are different in physical properties such as a degree of oxidation treatment, a DBP oil absorption amount, or a specific surface area by BET method utilizing nitrogen adsorption (a method of calculating the surface area per g from the amount of adsorbed nitrogen), can be used. Here, the DBP oil absorption amount (cc/100 g) denotes the amount of dibutyl phthalate (DBP) which can be absorbed by 100 g of carbon black and is a value defined by ASTM (U.S. standard test method) D2414-6TT. The BET method is defined by JIS K6217.

When two or more kinds of carbon blacks having different electrical conductivities are used in combination in the intermediate transfer belt, a surface resistivity of the belt can be adjusted by adding carbon black manifesting high electric conductivity is added in advance and then adding carbon black having a low electric conductivity. When two or more kinds of carbon blacks are contained in the intermediate transfer belt, mixing and dispersing of both carbon blacks can be enhanced by using acidic carbon black as at least one kind of them.

Specific examples of the acidic carbon black include PRINTEX® 150T (pH: 4.5, volatility: 10.0%), SPECIAL BLACK® 350 (pH: 3.5, volatility: 2.2%), SPECIAL BLACK® 100 (pH: 3.3, volatility: 2.2%), SPECIAL BLACK® 250 (H, 3.1, volatility: 2.0%), SPECIAL BLACK® 5 (pH: 3.0, volatility: 15.0%), SPECIAL BLACK® 4 (H, 3.0, volatility: 14.0%), SPECIAL BLACK® 4A (pH: 3.0, volatility: 14.0%), SPECIAL BLACK® 550 (pH: 2.8, volatility: 2.5%), SPECIAL BLACK® 6 (pH: 2.5, volatility: 18.0%), SPECIAL BLACK® FW200 (pH: 2.5, volatility: 20.0%), COLOUR BLACK® FW2 (pH: 2.5, volatility: 16.5%), and COLOUR BLACK® FW2V (pH: 4.5, volatility; 16.5%) (all manufactured by Degussa); and MONARCH® 1000 (pH: 2.5, volatility: 9.5%), MONARCH® 1300 (pH: 2.5, volatility: 9.5%), MONARCH® 1400 (pH: 2.5, volatility: 9.0%), MOGUL® L (pH: 2.5, volatility: 5.0%), and REGAL® 400R (pH, 4.0, volatility: 3.5%) (all manufactured by Cabot Corporation).

The carbon black herein used may be either commercially-available one or a resultant obtained by purifying commercially-available ones. Purification is a process to remove impurities which have been mixed during manufacturing such as a residual oxidizing agent, a treating agent, a byproduct, other inorganic impurities or organic impurities. The purification process may include: heating the carbon black at a high temperature of around 500 to around 1000° C. in an inert gas or in vacuum; organic solvent processing using carbon disulfide, toluene or the like; or mixing of water slurry or an aqueous organic acid solution to remove impurities. While the purification process is not limited as long as carbon black can be purified thereby, a purification process including heating of powder can be difficult in handling during manufacturing, and much energy may be employed. The purification process may be preferably the one that mainly use organic solvent or water. In particular, from a viewpoint of safety, a purification process which mainly uses water can be preferable. In order to prevent contamination by impurities, it is preferable to use water such as ion-exchanged water, ultrapure water, distilled water, or ultrafiltered water.

The surface of carbon black has high activity, and thus is likely to adsorb a substance. Therefore, purification of carbon black needs to be performed just before use. Specifically, the purification can be preferably performed 72 hours in advance of use, and more preferably 48 hours in advance of use, When the purification of carbon black is performed earlier than 72 hours in advance of use, impurities may be re-adsorbed to the carbon black surface, which may result in reduction of purification effects.

Specifically, the purification process may preferably include preparing a mixture in which carbon black and water are mixed as essential ingredients, mixing the mixture to form a slurry, and then separating carbon black from the slurry.

From the viewpoint of improving wettability of the surface of carbon black, substances having a surface activating function, e.g., so-called a surfactants or alcohols, may be added to a system of the purification process. While a water-soluble organic solvent can be added to a system of the purification process as required, it is preferable that no water-soluble organic solvent remains on an intermediate transfer belt produced therewith. Therefore, a solvent exhibiting a surface activating function at a low-boiling point is preferable. Examples of such a solvent include methyl alcohol, ethyl alcohol, n-propyl alcohol, isopropyl alcohol, sec-butyl alcohol, tert-butyl alcohol, 2-methoxyalcohol, and allyl alcohol. Further, inorganic acid may be added at an appropriate timing.

It is preferable that a method of mixing the slurry enables to degrade an aggregate, which may exist in the slurry, so that each of the acid carbon black particles has a primary particle diameter as much as possible. In consideration of this, it is preferable to treat the slurry with a common disperser or a homogenizer. Examples of devices used for the mixing method include a colloid mill, a flow jet mill, a slasher mill, a high speed disperser, a ball mill, an attritor, a sand mill, a sand grinder, an ultra fine mill, an Eiger motor mill, a Dino mill, a pearl mill, an agitator mill, a Cobol mill, a three-roll mill, a two-roll mill, an extruder, a kneader, a microfluidizer, a laboratory homogenizer, an ultrasonic homogenizer, and a jet mill. These dispersers and homogenizers may be used singly or in combination. Further, in order to prevent contamination with inorganic impurities, it is preferable to use a dispersion method which uses no dispersion media. The use of a microfluidizer, an ultrasonic homogenizer, a jet mill, or the like is suitable.

Examples of the method of separating carbon black from the slurry include centrifugal separation, filtration, and transferring of the acid carbon black to a water-insoluble organic solvent, whereby purified acid carbon black can be obtained. Examples of the water-insoluble organic solvent include toluene, xylene, benzene, chloroform, hexane, and heptane. From the viewpoint of assuring safety, centrifugation separation or filtration is preferable for the separation.

While it is preferable to dry carbon black obtained by the separation by heating in inert gas, a drying process is not necessarily required because a heating treatment is performed in a following transfer belt production.

The content of carbon black with respect to water in the slurry can be, for example, from about 5% by weight to about 30% by weight. More preferably is from about 5% by weight to about 20% by weight. When the content of carbon black is less than about 5% by weight, a yield ratio by purification can be lower, and sufficient productivity may not be achieved. Further, when the content of carbon black exceeds about 30% by weight, the viscosity of slurry may become too high to conduct the mixing, sometimes resulting in lowered purification efficiency.

Acid carbon black has higher dispersibility in a resin composition due to effects of an oxygen-containing functional group present on its surface as compared with common carbon black. Therefore, it is preferable to increase the additional amount thereof as the conductive agent since it enables to increase the amount of carbon black in the intermediate transfer belt, which brings out the effect of using the oxidation-treated carbon black such as suppressing in-plane fluctuation in the surface resistivity of the intermediate transfer belt.

Therefore, it is preferable that the content of acid carbon black be adjusted to from 10% by weight to 30% by weight. Thus, effects of acid carbon black, such as suppressing in-plane variation in surface resistivity of the intermediate transfer belt, are demonstrated. When the content thereof is lower than 10% by weight, uniformity of electrical resistance may decrease and in-plane non-uniformity in surface resistivity and electrical field dependency may become large. In contrast, when the content thereof exceeds 30% by weight, a desired resistance value may become hard to obtain. Furthermore, when the content of acid carbon black is adjusted to from 18% by weight to 30% by weight, the effects thereof are further demonstrated, whereby the in-plane non-uniformity of surface resistivity and the electrical field dependency are remarkably suppressed.

Next, an exemplary embodiment of producing the intermediate transfer belt using a polyamide acid solution, in which carbon black is dispersed as a conductive agent, will be described below, while a method of producing the intermediate transfer belt is not limited thereto.

First, purified carbon black is prepared and subjected to dispersing in an organic polar solvent. The dispersing can be preferably a method including dispersing carbon black with a disperser or a homogenizer after preliminary stirring is performed. In addition, the dispersing can be preferably a media-free dispersion method using no media is preferable, since contamination with fine media may reduce purification effect of carbon black, as is similar to the refining of carbon black. Particularly preferable examples of the media-free dispersion method include a method including utilization of a jet mill since it is capable of dispersing a high viscosity solution while suppressing unevenness in dispersing degree of carbon black.

The diamine component and the acid anhydride component are dissolved in the thus-obtained carbon black dispersion, and polymerization is performed to prepare a polyamide acid solution in which carbon black is dispersed.

The concentrations of monomers to be dissolved in the carbon black dispersion (namely, the concentration of the diamine component and the concentration of the acid anhydride component in a solvent) can be respectively determined depending on various conditions, and are respectively preferably from about 5% by weight to about 30% by weight. Further, the polymerization reaction temperature can be adjusted to preferably about 80° C. or lower, and particularly preferably from about 5° C. to about 50° C. The reaction time is from about 5 hours to about 10 hours.

Since the polyamide acid solution in which carbon black is dispersed is a high viscosity solution, an air bubble is generated during preparation of the solution is not naturally removed therefrom, and defects such as projection, recess or a hole due to an air bubble may occur upon coating of the solution for forming the belt. In consideration of this, the polyamide acid solution is desirably subjected to defoaming. It is preferable that the coating of the polyamide acid solution is performed as soon as possible upon the defoaming.

When a seamless belt is formed as the intermediate transfer belt of the invention, a formation of the seamless belt may be performed by an appropriate method according to conventional methods such as a method having: developing a polyamide acid solution in a ring-like manner by an appropriate manner such as immersing the solution in an external circumferential surface of a cylindrical mold, coating the solution on an internal circumferential surface of a cylindrical mold and may further centrifuging this, or filling the solution into an injection mold; drying the developing layer to make a film molded into a belt shape; heating the molded belt-shaped article to convert polyamide acid into imide; and recovering this from a mold (for example, see JP-A Nos. 61-95361, 64-22514, and 3-180309). The mold can be treated to be releasable upon formation of the seamless belt.

The conversion of polyamide acid to imide is generally performed by subjecting the polyamide acid to high temperature of about 200° C. or more. The conversion may not be sufficiently achieved when the temperature is lower than about 200° C. In contrast, while the conversion with high temperature can be advantageous for imide conversion to obtain stable properties, thermal efficiency of the conversion with high temperature can be inferior and high cost can be required due to the use of thermal energy. Thus, the heating temperature for the conversion may be determined in view of properties and productivity of the intermediate transfer belt.

The inner surface of the molded belt-shaped article is subjected to the process to give conductivity to form carbonized regions residing on the inner surface in a sprinkled manner. The annular body of one exemplary embodiment of the invention, such as an intermediate transfer belt, can be thus produced.

Next, properties of the intermediate transfer belt according to the exemplary embodiment will be described.

The hardness of the outer surface (transfer surface) of the intermediate transfer belt according to the exemplary embodiment is preferably about 30 or lower, and more preferably about 25 or lower in terms of surface micro hardness. The surface micro hardness is determined by a method of measuring how far an indenter is pressed into a sample, which is different from methods including determining the diagonal line length of an indentation such as in Vickers hardness widely used for measuring hardness of a metal material or the like. When a test load is defined as P (mN) and the intrusion amount (pressing depth) of the indenter into the sample is defined as D (micrometer), the surface micro hardness DH is defined by the following equation.

$$DH=\alpha P/D2$$

In the equation, $\alpha$ is a constant value which accords to a shape of the indenter, and the $\alpha$ can be 3.8584 in the case of a triangular pyramid indenter.

The surface micro hardness refers to the hardness determined based on overload provided in the process of pressing an indenter and pressing depth resulted thereby, and represents strength properties of a material in a state of plastic deformation as well as those of elastic deformation. Further, since an area subjected to the measurement is minute to be near a toner particle diameter, more exact measurement of hardness can be performed. There can be extremely exact correlation between the thus-obtained surface micro hardness and the level of occurrence of hollow character (phenomenon to form an image deletion in a transferred line-shaped image). More specifically, when the surface micro hardness of the transfer surface of the intermediate transfer belt is adjusted to the above range, deformation of the transfer surface of the intermediate transfer belt may occur due to thrust of a bias roller in a secondary transfer part, which may result in the thrust concentrated on a toner on the intermediate transfer belt can be diffused. Therefore, the toner may not be aggregated, and image quality defects such as hollow character in which a line image is omitted can be suppressed.

The surface micro hardness can be obtained by the following manner. A sheet of a material of a surface layer, which configurates the intermediate transfer belt, is cut into a small piece having around 5 nm squares, and the small piece is fixed to a glass plate with an instant adhesive. The surface micro hardness of a surface of the sample is measured using an ultra micro hardness tester (trade name: DUH-201S, manufactured by Shimadzu Corporation). Measuring conditions can be as follows.

Measuring environment: 22° C., 55% RH
Indenter used: triangle pyramid indenter
Test mode: 3 (soft material test mode)
Test load: 0.70 gf
Load rate: 0.0145 gf/sec
Holding time: 5 sec In the intermediate transfer belt according to the exemplary embodiment, the relationship between the Young's modulus and the displacement of the belt due to disturbance (load fluctuation) at the time of driving the belt is represented by the following equation.

$$\Delta 1=P\cdot 1\cdot \alpha/(t\cdot w\cdot E)$$

Herein, $\Delta 1$ represents displacement (μm) of a belt,
P represents load (N),
1 represents a belt length between two tension rolls (mm),
$\alpha$ represents a coefficient,
t represents a belt thickness (mm),
w represents a belt width (mm), and
E represents a Young's modulus ($N/mm^2$) of a belt material.

The elongation-shrinkage (displacement) of the belt due to disturbance (load fluctuation) at the time of driving the belt are inversely proportional to the Young's modulus and thickness of a belt material. When a belt material having a high Young's modulus is used, displacement of the belt due to disturbance (load fluctuation) at the time of driving the belt decreases, which may make belt deformation in response to stress at the time of driving be low, and a favorable image quality be stably achieved. When the belt thickness increases, deformation of the outer surface of the belt at a belt bending portion, such as a driving roll, may become large, which may bring about difficulty in obtaining a favorable image quality, and deformations of the outer side and the inner side of the belt increase, which may bring about belt breakage due to locally repeated stresses.

The thickness of the intermediate transfer belt according to the exemplary embodiment is preferably in the range of about 0.05 mm to about 0.5 mm, more preferably in the range of about 0.06 mm to about 0.30 mm, and still more preferably in the range of about 0.06 mm to about 0.15 mm in terms of the total thickness. When the total thickness of the intermediate transfer belt is lower than the range, it may be difficult to satisfy machine properties required to an intermediate transfer belt. When the total thickness of the intermediate transfer belt exceeds the range, stress on the belt surface may be concentrated due to deformation caused in a roll bending part, which may sometimes cause formation of cracks on the surface or the like.

The volume resistivity of the intermediate transfer belt according to the exemplary embodiment is preferably from about $1\times10^{11}$ Ωcm to about $1\times10^{14}$ Ωcm under the condition where 500 V is applied for 10 seconds. When the volume resistivity is lower than the range, minute white spots may appear on a formed image due to electrical discharge occurring by transfer. When the volume resistivity is higher than the range, electric charge may be accumulated, and thus electric charge may remain until the following cycle of a transfer belt, resulting in failure of transfer of images due to repeated use in some cases. Therefore, a charge eliminator device may be additionally required.

Herein, the volume resistivity can be measured using a circular electrode (e.g. trade name: UR PROBE of HIRESTA-UP, manufactured by Mitsubishi Chemical CO., Ltd) according to JIS K6911. A method of measuring the volume resistivity will be explained with reference to the drawings. The volume resistivity can be measured by the same apparatus as that used for measuring the surface resistivity, while the circular electrode as shown in FIGS. 3A and 3B is provided with a second voltage application electrode B' in place of the plate-like insulating body B.

An intermediate transfer body T is held between: the cylindrical electrode part C and the ring-like electrode part D at the first voltage application electrode A and the second voltage application electrode B', and a voltage V (V) is applied between the cylindrical electrode part C and the second voltage application electrode B' at the first voltage application electrode A, and a current I (A) which flows thereupon is measured, and the volume resistivity ρv (ΩQ/cm) of the intermediate transfer belt T can be calculated by the following equation. Herein, t represents a thickness of the semi-conductive intermediate transfer belt T (cm).

$$\rho v=19.6\times(V/I)\times t$$

Figure 5:
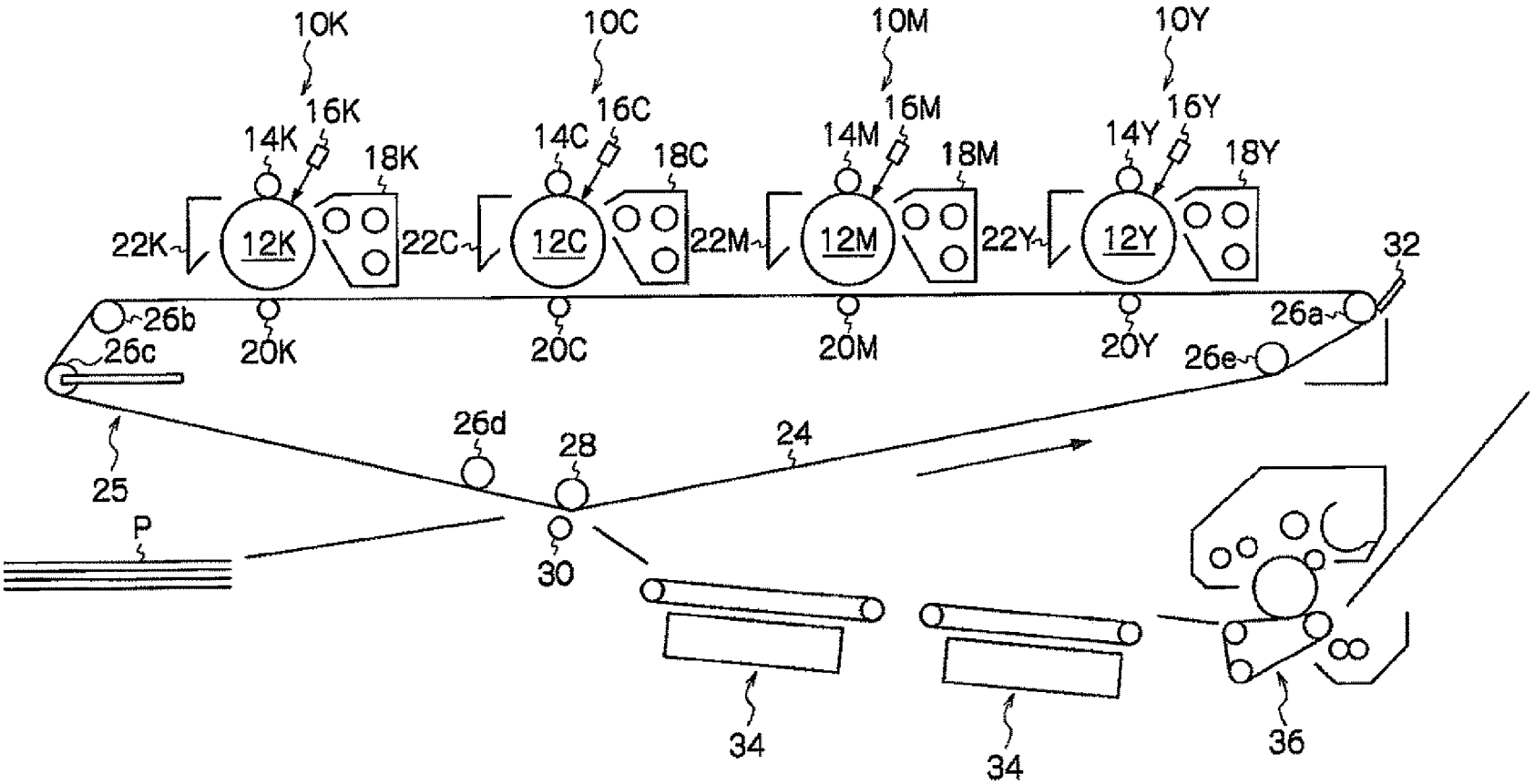
FIG. 5 is a schematic configuration diagram illustrating an exemplary embodiment of an image forming apparatus of one aspect of the invention.

FIG. 5 is a schematic view showing one exemplary embodiment of an image forming apparatus of one aspect of the invention.

The image-forming apparatus in the exemplary embodiment is an output machine having four photoreceptor drums for different colors.

As shown in FIG. 5, the image-forming apparatus in the exemplary embodiment has image-forming units 10Y, 10M, 10C, and 10K.

The image-forming units 10Y, 10M, 10*c*, and 10K include photoreceptor drums 12Y, 12M, 12C, and 12K (herein, Y is given to devices for yellow, M is given to devices for magenta, C is given to devices for cyan, and K is given to devices for black) respectively as image-holding members, and further include at the periphery of the photoreceptor drums 12Y, 12M, 12C and 12K charging devices 14Y, 14M, 14C, and 14K that charge the surfaces of the photoreceptor drums 12Y, 12M, 12C, and 12K respectively; exposure devices 16Y, 16M, 16C, and 16K that form an electrostatic latent image on the surface of each of the charged photoreceptor drums 12Y, 12M, 12C, and 12K respectively; developing devices 18Y, 18M, 18C, and 18K that develop the electrostatic latent image formed on the surface of each of the photoreceptor drums 12Y, 12M, 12C, and 12K respectively into toner images using a toner contained in a developer; primary transfer devices 20Y, 20M, 20C, and 20K (for example, transfer rolls) that transfer the toner images onto an intermediate transfer belt 24; and photoreceptor drum cleaners 22Y, 22M, 22C, and 22K that remove toner remaining on the surface of the photoreceptor drums 12Y, 12M, 12C, and 12K after image transfer.

In addition, an intermediate transfer belt 24 is installed as an intermediate transfer body, as it faces the image-forming units 10Y 10M, 10C, and 10K. The intermediate transfer belt 24 travels through the space between the photoreceptor drums 12Y, 12M, 12C, and 12K and the primary transfer devices (e.g., primary transfer rolls) 20Y, 20M, 20C, and 20K.

The intermediate transfer belt 24 is held rotatably, as it is pushed outward with tension from an inner circumferential side thereof by a drive roll 26*a*, a tension-steering roll 26*c* that prevents distortion or meandering of the intermediate transfer belt 24, supporting rolls 26*b*, 26*d* and 26*e*, and a backup roll 28 so as to configure a belt streching device 25.

A secondary transfer device 30 (e.g., secondary transfer roll) is installed on the periphery of the intermediate transfer belt 24 at a position facing the backup roll 28 via the intermediate transfer belt 24, and also, a belt cleaner 32 is installed downstream of the secondary transfer device 30 in the intermediate transfer belt 24-revolving direction.

A conveying device 34, which conveys the recording paper P (recording medium) carrying the transferred image from the secondary transfer device 30 is provided. Further, a fixing device 36 is provided at a position downstream of the conveying device 34 in the conveying direction.

In the image-forming apparatus in the exemplary embodiment, the photoreceptor drum 12Y in the image-forming unit 10Y revolves clockwise in the FIG. 5, and the surface thereof is charged by the charging device 14Y. An electrostatic latent image in the first color (yellow: Y) is formed on the charged photoreceptor drum 12Y by an exposure devise 16Y such as a laser-writing device.

The electrostatic latent image is developed with a toner (developer containing a toner) supplied by the developing device 18Y, to give a visualized toner image. The toner image advances to the temporary transfer region by rotation of the photoreceptor drum 12Y, where the toner image is primary-transferred onto the intermediate transfer belt 24 revolving counterclockwise in the FIG. 5, while an electric field in opposite polarity is applied from the primary transfer device 20Y to the toner image.

Similarly, a toner image in the second color (M), a toner image in the third color (C), and a toner image in the fourth color (K) are formed one by one by the image-forming units 10M, 10C, and 10K, and the toner images are superimposed on the intermediate transfer belt 24, forming a multi-color toner image.

Then, the multi-color toner image transferred on the intermediate transfer belt 24 advances to the secondary transfer region where the secondary transfer device 30 is placed, by rotation of the intermediate transfer belt 24.

In the secondary transfer region, the toner image is transferred onto a recording paper P by electrostatic repulsion, while a bias voltage (transfer voltage) in the same polarity with that of the toner image is applied between the secondary transfer device 30 and the backup roll 28 placed at the position facing it via the intermediate transfer belt 24.

The recording paper P is picked up one by one from the recording paper pile stored in a recording paper container (not shown in FIG. 5) by a pickup roller (not shown in FIG. 5), and fed into the space between the intermediate transfer belt 24 and the secondary transfer device 30 in the secondary transfer region at a particular timing by a feed roll (not shown in FIG. 5).

The toner image held on the intermediate transfer belt 24 is transferred onto the recording paper P supplied, by application of pressure and transfer voltage by the secondary transfer device 30 and the backup roll 28 and also by rotation of the intermediate transfer belt 24.

The recording paper P onto which the toner image has been transferred is fed into the fixing device 36 by the conveying device 34, where the toner image is fixed into a permanent image by application of pressure and heat.

The toner remaining on the intermediate transfer belt 24 after the multi-color toner image is transferred onto the recording paper P can be removed by the belt cleaner 32 installed at a position downstream of the secondary transfer region, before entering into the next transferring cycle. In addition, foreign materials deposited during transfer such as toner particles or paper dust can be removed by brush cleaning (not shown in FIG. 5) in the secondary transfer device 30.

In the case of transfer of a single-color image, a primary-transferred toner image in a single color is secondary-transferred and sent to the fixing device. In the case of transfer of a multicolor image in which multiple colors are superimposed, the rotation of the intermediate transfer belt 24 and the rotation of the photoreceptor drums 12Y, 12M, 12C, and 12K are synchronized to make the toner images superimposed accurately in the primary transfer region without any positional deviation.

In this way, an image can be formed on the recording paper P (recording medium) in the image-forming apparatus in the exemplary embodiment.

EXAMPLES

Hereinafter, the invention will be explained by way of examples, while the examples are provided only for exemplification, and it should be understood that the scope of the present invention is not restricted thereby.

Preparation of Endless Belt 1

A polyamide acid-containing NMP (N-methylpyrrolidone) solution (trade name: U IMIDE, manufactured by Unitika/Solid content: 20% by weight) containing biphenyl tetracarboxylic dianhydride (BPDA) and p-phenylenediamine (PDA) is provided, and carbon black (trade name: SPECIAL BLACK 4, manufactured by Degussa) is added thereto in an amount of 18% by weight with respect to the polyamide acid-containing NMP solution (in terms of solid mass ratio) and is dispersed with a jet mill disperser (trade name: GEANUS PY, manufactured by Genus) with a condition of 200 N/mm$^2$ and 5-pass. The produced polyamide acid solution having the dispersed carbon black is made to pass through a 20 μm-stainless steel mesh to remove foreign substances and aggregates of carbon black. Then, vacuum defoaming is carried out to form a final coating solution.

Next, the thus-obtained polyamide acid solution is applied to the outer surface of a cylindrical die (outside diameter: 302 mm, length: 500 mm, and thickness: 10 mm) through a dispenser so that a film formed by the coating has a thickness of 0.5 mm. Then, the resultant is rotated at 1,500 rpm for 15 minutes. Thereafter, hot air (60° C.) is applied to the die from the outside thereof for 30 minutes while rotating the die at 250 rpm. Then, the die is heated at 150° C. for 60 minutes. Thereafter, the die is raised, and the temperature is increased up to a calcination temperature (300° C.) for imide conversion to thereby obtain a polyimide belt. The thickness of the belt is 100 μm. The both ends of the belt are cut to obtain a final product (an endless belt 1) having a desired width.

Preparation of Endless Belt 2

An endless belt 2 is prepared in the same manner as the endless belt 1, except that the amount of the carbon black is added to the polyamide acid-containing NMP solution is changed to 16% by weight with respect to the polyamide acid-containing NMP solution in terms of solid mass ratio.

Preparation of Endless Belt 3

An endless belt 3 is prepared in the same manner as the endless belt 1, except that the amount of the carbon black is added to the polyamide acid-containing NMP solution is changed to 21% by weight with respect to the polyamide acid-containing NMP solution in terms of solid mass ratio.

Examples 1 to 6

The obtained endless belts 1 to 3 are subjected to the process to give conductivity to the inner surface thereof (see FIG. 4) as explained above. A paper P (trade name, manufactured by Fuji Xerox Co. Ltd.) is used. In each of the Examples, the inner surface of each endless belt is subjected to process to give conductivity under the conditions of the applied current value and the number of times of contact-and-separation as shown in Table 1 to obtain an intermediate transfer belt having carbonized regions residing on the inner surface thereof in a sprinkled manner. The process to give conductivity to the inner surface of the belt can be performed at a temperature of 10° C. and a humidity of 15% (absolute humidity of 1.36 g/m$^3$).

TABLE 1

| | Example 1 | Example 2 | Example 3 | Example 4 | Example 5 | Example 6 |
|---|---|---|---|---|---|---|
| Current value | 40 μA | 40 μA | 80 μA | 40 μA | 80 μA | 80 μA |
| Number of times of contact-and-separation | 100 times | 200 times | 20 times | 100 times | 20 times | 30 times |
| Endless belt | Endless belt 1 | Endless belt 1 | Endless belt 1 | Endless belt 3 | Endless belt 2 | Endless belt 1 |

Examples 7 to 11

The intermediate transfer belts of Examples 7 to 11 are prepared in the same manner as Examples 1 to 6, except that the process to give conductivity to the inner surface of the belt is performed by varying the conditions of the applied current value and the number of times of contact-and-separation as shown in Table 2 respectively.

TABLE 2

| | Example 7 | Example 8 | Example 3 | Example 10 | Example 11 |
|---|---|---|---|---|---|
| Current value | 8 μA | 100 μA | 40 μA | 20 μA | 80 μA |
| Number of times of contact-and-separation | 10,0000 times | 3 times | 100 times | 100 times | 40 times |
| Endless belt | Endless belt 1 | Endless belt 1 | Endless belt 2 | Endless belt 1 | Endless belt 1 |

Comparative Example 1

The endless belt 1 is used as it is as an intermediate transfer belt without being subjected to the process to give conductivity to the inner surface thereof.

Comparative Example 2

An isopropyl alcohol (trade name: AERODAG G, manufactured by Japan Atison), in which graphite is dispersed, is sprayed to the inner surface of the endless belt 1, and dried at normal temperature (25° C.). Since the total film thickness becomes 112 μm, the film thickness of the conductive layer formed on the inner surface is presumed to be 12 μm.

Comparative example 3

The amount of the sprayed isopropyl alcohol is reduced so that the thickness of the conductive layer is further reduced as compared with Comparative Example 2. However, coating unevenness occurs, and thus Comparative example 3 cannot be used as an intermediate transfer belt.

Evaluation

Each of the thus-obtained intermediate transfer belts is evaluated for the following items. The results are shown in Table 3.

Evaluation of Surface resistivity and Volume resistivity

The volume resistivity of the intermediate transfer belt and the surface resistivity of each of the outer and inner surfaces thereof are measured according to the explanation in the Detailed Description. A current value after a voltage of 500 V is applied for 10 seconds under the environment of a temperature of 22° C. and a humidity of 55% RH is determined using a circular electrode (trade name: UR probe of HIRESTER IP, manufactured by Mitsubishi Chemical Corporation, outer diameter of a cylindrical electrode C: 16 mm, inner diameter of a ring electrode: 30 mm, and outer diameter of a ring electrode: 40 mm). Then, the volume resistivity of the intermediate transfer belt and the surface resistivity of each of the outer and inner surfaces thereof are calculated based on the determined current value.

Measurement of Thickness of Carbonized region

The surface resistivity is measured while polishing the inner surface of the belt side with a wrapping film polishing material #10000 manufactured by Sumitomo 3M Limited. The polished thickness with which the measured surface resistivity is equal to the surface resistivity of the inner surface of the endless belt before being subjected to the process to give conductivity to the inner surface thereof is defined as the thickness of the carbonized region. The surface resistivity is measured by an eddy-current coating thickness gauge (trade name: CTR-1500E, manufactured by Santo Electronics Co., Ltd.).

Detection of Presence of Carbonized Region

The formation of the carbonized region is detected by obtaining a difference between a ratio of the —C—C— bond peak area (carbon-to-carbon bond peak area) relative to the peak area of all the chemical bonds, in which the areas are measured before the endless belt is subjected to the process to give conductivity to the inner surface thereof, and a ratio of the —C—C— bond peak area relative to the peak area of all the chemical bonds, in which the areas are measured after the process to give conductivity to the inner surface thereof using JPS-9010 (trade name, manufactured by JEOL Co., Ltd.). The measurement is performed under an argon atmosphere, at an acceleration voltage of 10 kV, and at an electric current of 20 mA. The measurement is performed at 5 points, and then the average of the measured values is taken as the difference (increment). The differences (increments) of Examples and Comparative examples are shown in Table 3.

Evaluation of Image quality

The intermediate transfer belt is evaluated for image quality using a machine modified by mounting the intermediate transfer bel on DocuCentre Color 2220 (trade name, manufactured by Fuji Xerox). Image quality evaluation is carried out by visually observing image quality defects (flaky pattern) in sample halftone images with a tone value of 20%, 30%, or 50% and 12-point characters.

G1: No flaky pattern is visually observed at all.

G2: Although a flaky pattern is slightly observed visually, it is within the tolerable range.

G3: A flaky pattern is clearly observed visually.

TABLE 3

| | Surface resistivity of Outer surface of Belt (Log Ω/□) | Surface resistivity of Inner surface of Belt (Log Ω/□) | Volume resistivity of Belt (Log Ω) | Film thickness of Carbonized region (μm) | Increment of area ratio of C—C bond of Carbonized region (%) | Image quality |
|---|---|---|---|---|---|---|
| Example 1 | 13.6 | 12.6 | 13.0 | 4.1 | 3.5 | G1 |
| Example 2 | 13.6 | 12.4 | 13.0 | 4.2 | 3.9 | G1 |
| Example 3 | 13.6 | 12.0 | 12.8 | 6.0 | 5 | G1 |
| Example 4 | 12.0 | 11.0 | 11.8 | 4.1 | 3.6 | G1 |
| Example 5 | 14.8 | 12.9 | 13.8 | 6.0 | 5.1 | G1 |
| Example 6 | 13.6 | 11.7 | 12.9 | 6.2 | 5.3 | G1 |
| Example 7 | 13.6 | 13.5 | 13.2 | 0.2 | 0.3 | G2 |
| Example 8 | 13.6 | 13.4 | 13.2 | 0.5 | 0.4 | G2 |
| Example 9 | 12.0 | 10.8 | 13.8 | 4.2 | 3.6 | G1 (Image deletion) |
| Example 10 | 13.6 | 13.2 | 13.2 | 2.1 | 1.8 | G1 (Poor character reproducability) |
| Example 11 | 13.6 | 11.5 | 12.9 | 6.8 | 5.8 | G1 (Non-uniformity in halftone |
| Comparative example 1 | 13.6 | 13.5 | 13.2 | — | 0 | G3 |
| Comparative example 2 | 13.6 | 5.6 | 9.8 | 12 | — | G3 (White spot, Non-uniformity in halfton, and Image deletion |
| Comparative example 3 | — | — | — | — | — | — |

It is understood from the results that Examples of the invention can provide images in which the formation of a flaky pattern has been suppressed as compared with Comparative Examples.

While the flaky patterns which are slightly observed in Examples 7 and 8 as compared with Example 1 to 6, the extent thereof are not substantially problematic in practical use. Although no flaky pattern is observed in Examples 9, 10, and 11, a white patch, poor character reproducibility, and non-uniformity in halftone are respectively observed therein.

What is claimed is:

1. An annular body consisting of a single layer, the single layer comprising a resin and a conductive agent, and the single layer having a carbonized region on its inner surface, wherein the carbonized region comprises a carbonized portion which resides from the inner surface in the thickness direction of the single layer, the thickness of the carbonized region is up to about 10 μm, and the carbonized region is dispersed on the inner surface of the single layer.

2. The annular body of claim 1, wherein the carbonized region is formed by a process to give conductivity to the inner surface of the single layer.

3. The annular body of claim 1, wherein the surface resistivity of the inner surface of the single layer is in a range of about $1\times10^{11}\Omega/\square$ to about $1\times10^{13}\Omega/\square$, and the surface resistivity of the inner surface of the single layer is lower than that of an outer surface of the single layer by about 0.5 log $\Omega/\square$ to about 2.0 log $\Omega/\square$.

4. The annular body of claim 1, wherein the thickness of the carbonized region is from about 0.1 μm to about 7.0 μm.

5. An annular body stretching device comprising:

the annular body of claim 1; and a stretching unit pushing outward the annular body with tension from an inner circumferential side of the annular body.

6. The annular body stretching device of claim 5, wherein the carbonized region is formed by a process to give conductivity to the inner surface of the single layer.

7. The annular body stretching device of claim 5, wherein the surface resistivity of the inner surface of the single layer is in a range of about $1\times10^{11}\Omega/\square$ to about $1\times10^{13}\Omega/\square$, and the surface resistivity of the inner surface of the single layer is lower than that of an outer surface of the single layer by about 0.5 log $\Omega/\square$ to about 2.0 log $\Omega/\square$.

8. The annular body stretching device of claim 5, wherein the thickness of the carbonized region is from about 0.1 μm to about 7.0 μm.

9. An image forming apparatus comprising:

an image holding unit;

a charging unit that charges a surface of the image holding unit;

a latent image forming unit that forms a latent image on a surface of the image holding unit;

a developing unit that develops the latent image into a toner image;

a primary transfer unit that transfers the toner image to an intermediate transfer body;

a secondary transfer unit that transfers the toner image from the intermediate transfer body to a recording medium; and a fixing unit that fixes the toner image onto the recording medium, the intermediate transfer body being the annular body of claim 1.

10. The image forming apparatus of claim 9, wherein the carbonized region is formed by a process to give conductivity to the inner surface of the single layer.

11. The image forming apparatus of claim 9, wherein the surface resistivity of the inner surface of the single layer is in a range of about $1\times10^{11}\Omega/\square$ to about $1\times10^{13}\Omega/\square$, and the surface resistivity of the inner surface of the single layer is lower than that of an outer surface of the single layer by about 0.5 log $\Omega/\square$ to about 2.0 log $\Omega/\square$.

12. The image forming apparatus of claim 9, wherein the thickness of the carbonized region is from about 0.1 μm to about 7.0 μm.

13. A method for forming the annular body of claim 1, comprising forming the carbonized region by a process to give conductivity to the inner surface of the single layer.

14. The method of claim 13, wherein the process to give conductivity to the inner surface of the single layer comprises bringing paper into contact with the inner surface of the single layer to provide an electric field to the single layer.

* * * * *